United States Patent [19]

Wenzel

[11] 3,971,561

[45] July 27, 1976

[54] STORABLE MULTI-USE CHILDREN'S EXERCISING ASSEMBLY

[76] Inventor: Le Roy S. Wenzel, 630 S. 124th Ave., Omaha, Nebr. 68154

[22] Filed: July 20, 1973

[21] Appl. No.: 381,358

[52] U.S. Cl. ..... 272/56.5 R; 272/109

[51] Int. Cl.[2] ..... A63G 21/00; A63B 17/04

[58] Field of Search ..... 272/56.5 R, 56.5 SS, 272/60 R, 60 A

[56] References Cited

UNITED STATES PATENTS

| | | | |
|---|---|---|---|
| 790,613 | 5/1905 | Boyle | 272/56.5 R |
| 880,964 | 3/1908 | Boyle | 272/56.5 R |
| 932,902 | 8/1909 | Reach | 272/60 R |
| 1,822,786 | 9/1931 | Raffo | 272/60 R |
| 2,206,581 | 7/1940 | Shapiro | 272/60 R |
| 2,768,828 | 10/1956 | Pack | 272/56.5 R X |
| 3,544,125 | 12/1970 | Unno | 272/56.5 R X |

FOREIGN PATENTS OR APPLICATIONS

| | | | |
|---|---|---|---|
| 26,343 | 12/1963 | Germany | 272/60 R |
| 381,640 | 10/1932 | United Kingdom | 272/56.5 R |

*Primary Examiner*—Richard C. Pinkham
*Assistant Examiner*—Arnold W. Kramer
*Attorney, Agent, or Firm*—Hiram A. Sturges

[57] ABSTRACT

A children's exercising assembly two sections of which have aligned upper surfaces forming a slide, the third section forming a ladder to reach the slide, the sections collapsing into parallelism for storage, all sections having rungs, which latter are covered on the slide sections by flat removable slide boards, the assembly being convertible to a gymnastics unit by altering positions of endmost sections.

5 Claims, 9 Drawing Figures

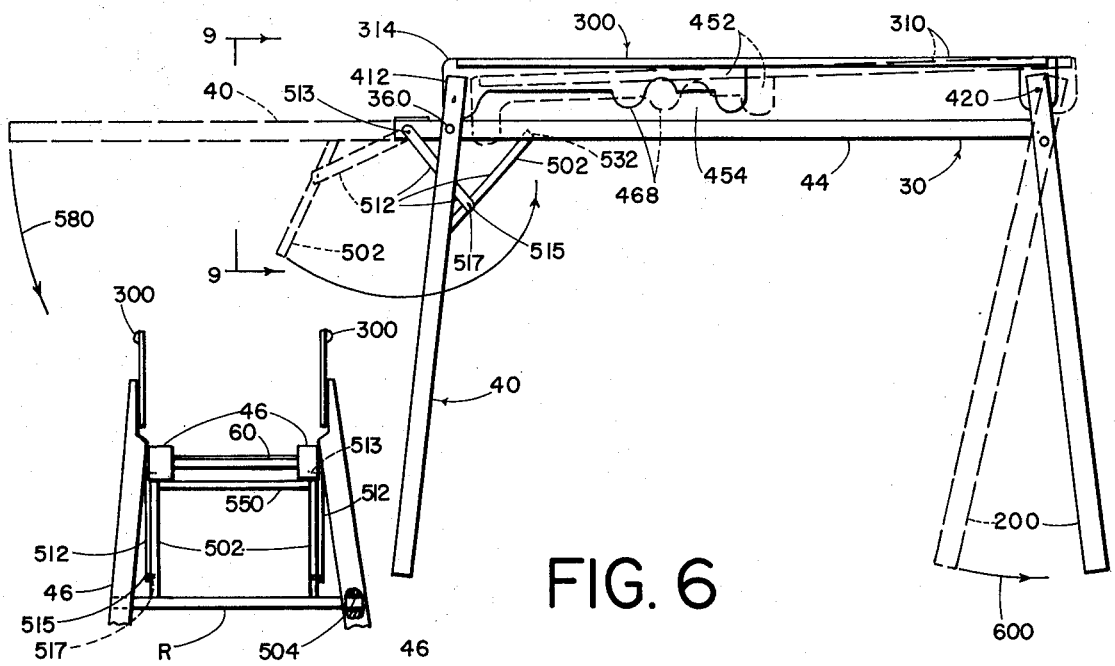
FIG. 6
FIG. 9
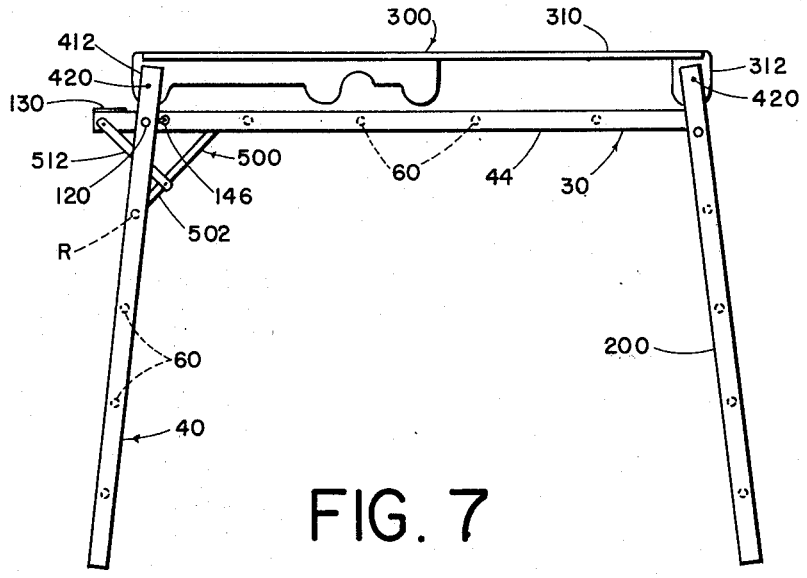
FIG. 7
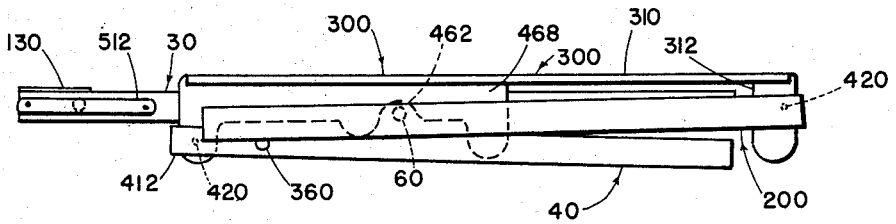
FIG. 8

STORABLE MULTI-USE CHILDREN'S EXERCISING ASSEMBLY

FIELD OF THE INVENTION

This invention is in the field of children's playing equipment for indoor use, and most particularly, the field of slides and gymnastic units called "jungle gyms".

DESCRIPTION OF THE PRIOR ART

Variety in play equipment for children, which can give them needed exercise when they must be indoors is very important. Children's slides, for example, have been proposed in the prior art for indoor use, but have not been purchased by parents as they might have been because they take up so much room in space that is already at a premium. For that reason, a collapsible slide that will store compactly has long been needed.

A popular type of play equipment is a gymnastics unit, called the "jungle gym" having ladder-like uprights supporting a horizontal ladder-like central section which children can either climb over or hang from by their arms.

However, "jungle gyms" consume a great quantity of space and are in the way at times when they are not being used.

In addition, a certain amount of danger is involved in playing on slides and "jungle gyms" so that it would be desirable if parents could have these pieces of equipment safely stored away, except at times when they are to be used when play can be supervised.

SUMMARY OF THE INVENTION

A collapsible children's exercising assembly comprising: a central section and a first support section held in alignment and having upper surface means forming a slide surface, an upright second support section serving as a ladder to reach the uppermost part of the slide, releasable means securing the first and second support sections to opposite ends of the central section rigidly but releasably so that at desired times the sections can be compactly stored alongside each other in parallelism.

Each section having parallel side members and transverse rungs and the sections being secured together in a releasable manner such that they can be connected in a position with the central section horizontal and the support sections upright for converting the slide unit into a "jungle gym" unit. This conversion being facilitated by guard rails disposed above the central section being pivotally connected to respective sides of adjacent ends of the support members to hold the guard rails in place when used as a slide unit and to employ the guard rails as a safety feature when the assembly is used as a gymnastics unit or "jungle gym".

A leg assembly supporting an upper portion of the lower support section being connectable into a different position for providing rigidity of support in attaching the sections for use as a gymnastics unit.

BRIEF DESCRIPTION OF THE DRAWING

FIG. 6 is a side elevation of the exercising assembly of this invention showing its parts in position for forming a gymnastics unit, dotted line positions of certain of the parts being shown to indicate the method of their movement in the conversion from positions for use of the assembly as a slide unit to use of the assembly as a gymnastics unit.

FIG. 7 is a side elevation of the parts of the assembly in finished position as a gymnastics unit.

FIG. 8 is a side elevation of the parts of the assembly of this invention shown in position of collapse for compact storage.

FIG. 9 is a forward elevation of the parts in the gymnastics unit position of FIG. 6 as seen along the line 9—9 of FIG. 6, whereby lower portions of a first support section are broken away.

DESCRIPTION OF THE PREFERRED EMBODIMENT

Figure 1:
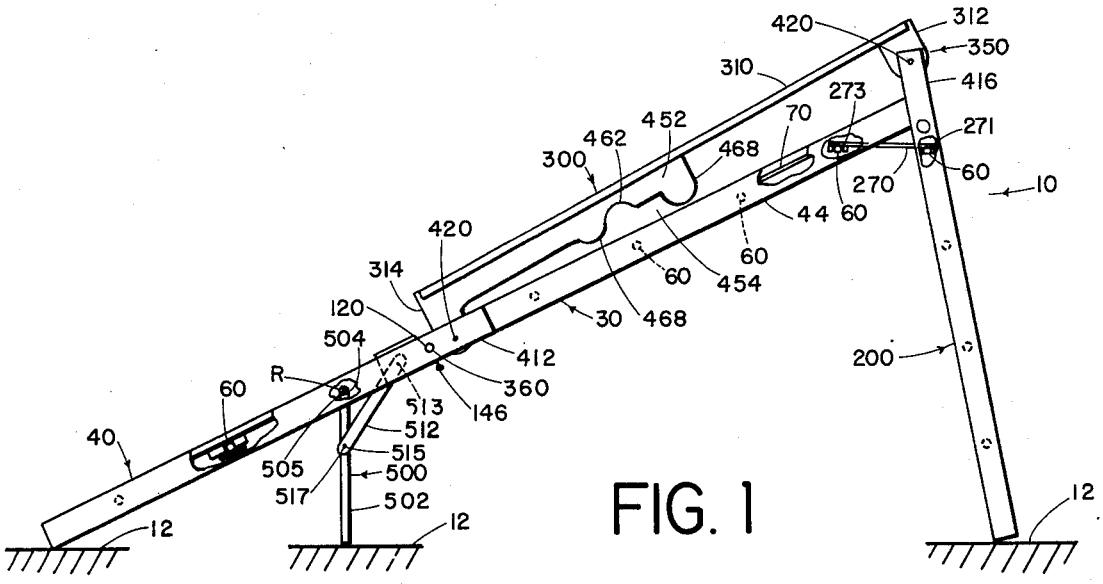
FIG. 1 is a side elevation of the collapsible children's exercising assembly of this invention shown in a position for use as a slide, portions of the floor surface supporting this slide being diagrammatically shown and portions of the assembly being broken away to show other parts in section.

The collapsible children's exercising assembly of this invention is generally indicated at 10 in FIG. 1 and is adapted to rest upon a floor surface shown at 12, the latter being flat and horizontal.

The exercising assembly 10 comprises an elongated central section 30 and an elongated first support section 40, these two sections having side members 44 and 46 respectively, which latter are spaced apart.

The side members 44 of the section 30 are preferably in parallelism, but the side members 46 of the section 40 are preferably more widely spaced apart at their lower ends than at their upper ends.

Sections 30 and 40 each have their side members interconnected by respective transverse rungs in the manner of a ladder, the rungs 60 all being parallel to each other. Positions of the rungs 60 can be seen in FIG. 1 in dotted lines and they are disposed spaced downwardly from the upper sides of the side members 44 and 46 so that upper and lower slide panels 70 and 72 formed of plywood and flat on upper and lower sides thereof, can be disposed between the respective side members 44 and 46 and be supported by the upper sides of the rungs 60.

Figure 4:
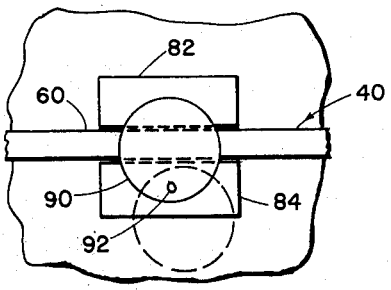
FIG. 4 is a bottom plan view of a section of an underside of a first support section showing how a flat slide panel is removably attached to a rung thereon.

The method of attaching the slide panels to their respective sections 30 and 40 is illustrated in FIGS. 1 and 4 in which the attachment assembly comprises blocks 82 and 84 disposed on each side of a rung 60 of the section 40 and closely thereto with a circular latching member 90 pivotally mounted at 92 to a block 84 being swingable from an unlatching position shown in dotted lines to a position for latching across the respective rung 60, as shown in full lines in FIG. 4.

Figure 2:
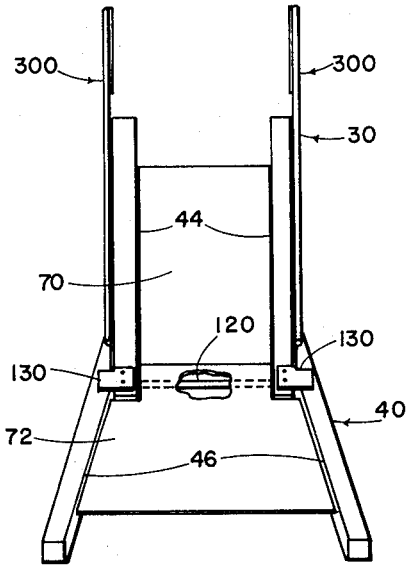
FIG. 2 is a frontal elevation of the slide of FIG. 1 with a portion broken away and with parts of a pivot member shown partially in dotted lines and partially in full line.

Referring to FIGS. 1 and 2, a dowel or pivot axle 120 is disposed through upper portions of the side members 46 of the first support section 40, the pivot axle 120 also extending through openings in the side members 44 of the central section 30.

The pivot axle 120 cooperates with bearing plates 130 which are attached to the upper side of the forward ends of respective side members 44 of the central section 30. The plates 130 extend outwardly over the upper sides of respective side members 46 of the first support section 40. Since the bearing plates 130 are strong, they cooperate with the axle 120 for preventing the flexing of the sections 30 and 40 out of aligned positions due to the effect of gravity or of children sliding downwardly across the slide panels 70 and 72.

The dowel 120 is secured in place by an eye screw or set screw 146 which can be caused to press against or release the dowel or axle 120 so that it can be removed, facilitating compact storage as in FIG. 8.

Figure 3:
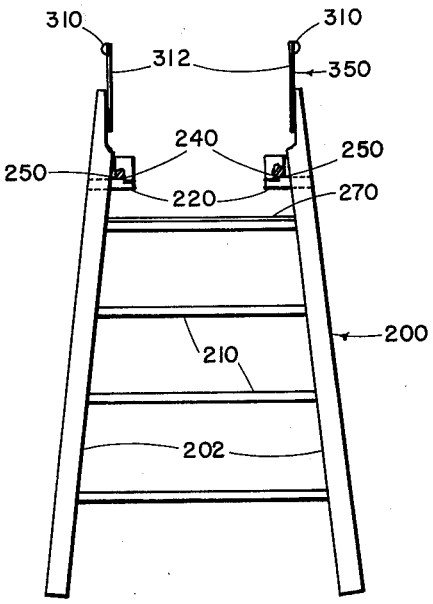
FIG. 3 is a rear elevation of the second support portion of the slide as it would be seen from the right in FIG. 1 with innermost sections only of the side members of a central section of the slide being shown in position thereon.

The exercising assembly 10 has a third support section 200 best seen in FIGS. 1 and 3, which latter has two side members 202 disposed in general parallelism, but with the lower ends thereof spaced apart a greater distance than the top ends for stability. The side members 202 are interconnected by parallel rungs 210 on which a child can climb to reach the upper end of the upper slide panel 70.

The upper end of the second support section 200 has inwardly extending shoulders 220 each extending inwardly from a respective one of the side members 202 a short distance.

The central section 30 has its side members 44 provided with notches on their upper ends and at the undersides thereof so as to receive therein the upper sides of the shoulders 220, as best seen in FIG. 3, lines 240 indicating the inner sides of the notches, while the notches themselves are given the numeral 250 and portions of the side members 44 of the central section 30 are broken away in FIG. 3 to show the notches 250.

The central section 30 is further secured to the second support section 200 by a suitable disconnectable standing and sitting platform 270, best seen in FIG. 1, which extends substantially from one to the other of the side members 202 of the sections 200, as best seen in FIG. 3. The platform 270 has a notch 271 on the underside thereof which removably receives the top and forward and rearward sides of a top one of the rungs 60 of the second support section 200, as seen in FIG. 3, and also as seen in FIG. 1, because a portion of the second section 200 is broken away in FIG. 1 to show this.

The platform 270 has a forward notch 273 under the forward end of the platform receiving in like manner, removably, the top of and the forward and rearward sides of the rearwardmost rung 60 of the central section 30, as best seen in FIG. 1.

As best seen in FIGS. 1 and 2, guard rail assemblies 300 are disposed at the right and left sides of the central section 30 and each comprise an uppermost elongated section 310 having attached thereto downwardly extending end sections 312 and 314.

The guard rail assemblies 300 are each connected to the remainder of the exercising assembly by a connecting means generally indicated at 350 and which comprises having the first support section 40 provided with a pivotal attachment to the central section 30, as accomplished by the axle 120, earlier described, for permitting a swinging of the first support section 40 about an axis through the elongated axle 120, which latter axis can be considered to be indicated at 360 in FIG. 1, the axis 360 being disposed transverse to and generally at a right angle to the elongation of the central section 30.

The connecting means 35C, because it includes the axle 120 permits a folding of the first support section 40 into a position shown at 40 in FIG. 6 in full lines, and also into a position shown at 40 in full lines in FIG. 8, the latter positions being one for collapsing and storage.

The connecting means 350 further comprises having the first support section 40 provided with upper portion 412 projecting upwardly beyond the pivotal attachment at the axis 360 and axle 120 to the central section 30; and still further comprises the second support section 200 having an uppermost portion 416 projecting upwardly beyond the central section 30 when the parts are in the position for use as a slide.

Figure 5:
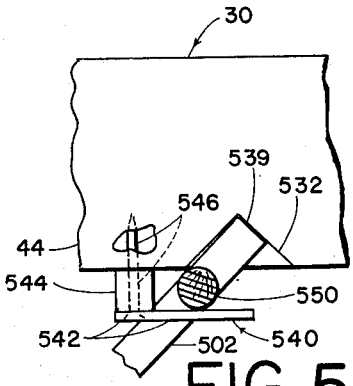
FIG. 5 is a detail showing a portion of a first support section and showing the method of connecting it to a brace by means of a locking latch assembly, a transverse member of the brace being shown in cross-section being gripped by the locking latch.

The connecting means 350 further comprises bolts 420 which attach the end sections 312 and 314 of the guard rail assembly 300 on the left side of the exercising assembly to upper end portions 412 and 416, as described, whereby this pivoting allows the first support section 40 to be moved, as earlier described, and also allows the second support section 200 to swing from the dotted line position shown in FIG. 6 to the full-line position shown in FIG. 6, as accomplished simply by releasing the latch assembly 540 shown in FIG. 5, and the manual swinging of the section 200 to a new position.

Similar pivot bolts 420 are provided for attaching the right-hand guard rail assembly 300 to the support sections 40 and 200 on the right-hand side thereof.

Each guard rail assembly 300 is provided with a gap-closing portion 452 which extends downwardly from the uppermost portion 310 thereof along most of the lower half of the length of each guard rail assembly 300. Each gap-closing portion 452 is a flat member on each of its sides and it is designed to close as much of the gap as possible that exists in that area between the top of the central section 30 and the relatively thin top section 310 of the respective guard assembly 300.

The gap referred to can be seen in FIG. 1 at 454 and it is to be observed that the underside of the gap-closing section 452 is provided with a notch 462 disposed opposite one of the rungs 60 of the central supporting section 30 so that the notch 462 receives the respective rung 60 to permit the gap-closing portion 452 to be disposed substantially alongside the central section 30 during storage, as seen in FIG. 8, for compact storage.

Other characteristics of the gap-closing portion 452 are that it has downwardly extending portions 468 in certain places where they will not interfere with the rungs 60 therebeneath during collapsing so as to enclose as much of the gap 454 as possible.

Referring now to FIG. 1, a leg assembly generally indicated at 500 is there shown and comprises a left leg 502 extending downwardly to the plane occupied by the upper surface of the floor 12, extending downwardly, that is, from the first support section 40 to which it is attached at its upper end by means of having the upper ends of the legs 502 permanently attached to a special rung 60 which is labeled R, and which latter is freely received in the side members 46 of the first support section 40 so that the rung can rotate in a manner permitting the legs 502 to swing about a horizontal axis 505 through the rung 60 shown at R.

Right and left braces 512 are attached permanently at their upper ends to the outer sides of the forward ends of the side members 44 of the central section 30 so that they are permanently attached by screws 513 in a manner for permitting the braces 512 to pivot about horizontal axes through the screws 513.

In the FIG. 1 slide position, the lower ends of each brace 512 are secured to the respective leg 502 by means of pegs 515, each of which is permanently attached to the respective leg 502. Each peg 515 is received in a hole 517 in the respective brace 512 so that the pegs 515 extend horizontally and tend to hold the braces 512 for bracing the legs 502.

In the FIG. 1 slide position, each brace 512 extends from a point between the ends of its respective leg 502 upwardly and at an acute angle to its respective leg rearwardly to the respective screw 513.

In operation, children can slide on the assembly when it is disposed in the position shown in FIG. 1 and when it is desired to change the assembly to the formation of a gymnastics unit commonly called a "jungle gym", as shown in FIG. 6, the section 40 is swung from the dotted position shown in FIG. 6 in the direction of the arrows of FIG. 6 to a full-line position. This is made possible by the releasing of latches 54, later described, without separation of the braces 512 from the legs 502 by simply leaving the braces 512 on the pegs 515, as will automatically advance the legs 502 to floor positions.

After the first support section 40 has been swung into the upright position shown in FIG. 6, then that one of the ends of legs 502 which was the formerly lower end respectively will then have become the upper end, as best seen in FIGS. 5 and 6.

Referring now to FIG. 5, it will be seen that since the leg assembly 500 has right and left legs 502 that a cross member 550 extends from the right to the left leg and is firmly attached to both and extends horizontally.

In the "gym" or gymnastics position of FIG. 6, partially also shown in FIG. 5, the ends 539 of the legs 502 are received in notches 532 in the undersides of the side members 44 respectively of the central section 30, the notches 532 being shaped for preventing the legs 502 from moving upwardly with respect to the central section 30 and also from moving inwardly toward a center of the central section 30.

The legs 502 are maintained in the position of FIGS. 5 and 6 by means of a latch assembly generally indicated at 540 having a latch 542 pivoting on a screw 546 and extending into the underside of the respective side portion 44 of the central section 30 with the latch 542 spaced from the respective side portion 44 by the spacer 544 so that the latch 542 can engage the underside of the cross member 550. In total, there are two latch assemblies 540, one for the left side of the unit and one for the right side of the unit, connected respectively to the left and right side members 44.

The latches 542 can be swung out of the way of the cross member 550 for disconnecting the legs 502 from the central section 30 to made possible moving the section 40 either into the slide position of FIG. 1 or into a folded position of FIG. 8.

For moving the parts from the FIG. 6 gymnastics unit position to the FIG. 8 collapsed position, the brace 512 is moved so that its hole 517 no longer receives the peg of the leg 502, whereby the brace 512 is free to move into a collapsed position parallel to the central section 30, as shown in FIG. 8, by pivoting around its screw 513 where it is permanently mounted to the central section 30, as earlier described, to hold the number of loose parts to a minimum.

As seen in FIG. 6, the conversion of the unit from the slide position of FIG. 1 to the gymnastics unit position of FIG. 6 also involves the movement of the second support section 200 in the direction of an arrow 600 from the dotted line position of FIG. 6 to the full line position thereof, all as is permitted by the pivot bolts 420 after the platform 270 has been removed by simply raising it up, off and out of the way.

Movement of the first support section 40 downwardly from the dotted line position 40 in FIG. 6 in the direction of the arrow 580 to the full line position 40 of FIG. 6 can be manually done easily as above described by pivoting about the axle 120, as earlier described.

One important aspect of the invention is that each forward pivot bolt 420 of the guard rail assembly 300 is located farther from the closest axle 120 than is each rearward pivot bolt 420 from the closest shoulder 220; because of these differences in distance, when section 40 is moved from the "jungle gym" position to the slide postion, it moves in a wide arc while section 200 moves a very small arc, all as shown in FIG. 6.

To move parts to the storage position of FIG. 8, the dowel or axle 120 is removed.

The central section 30, the first support section 40, and the second support section 200, are all interconnected by what can be called a section-connecting means 1000, which latter can be considered to comprise the removable axle 120, the plates 130 for providing rigidity, the notches 250 of FIG. 3, the shoulders 220 cooperative with the notches 250, the platform 270 with its notch 271, the top rung 60 cooperative with the notch 271, the forward notch 273 of the platform 270 and the rung 60 with which it is cooperative in FIG. 1.

As thus described, the section-connecting means 1000 will connect the sections together in a manner permitting the placement into the storage position shown in FIG. 8 and also holding them rigidly in the slide position of FIG. 1, all alternatively, holding them rigidly in the jungle gym position of FIG. 6, although in the latter case, the section-connecting means 1000 must be considered also to include, at least in the embodiment shown in the drawings by way of example, the legs 502 of FIG. 6 and the notches 532 cooperative therewith, and the braces 512 and pegs 515, holes 517, screws 513, and a special rung 60 which is labeled R in FIG. 1 to which the legs 502 are attached.

I claim:

1. A collapsible children's exercising assembly comprising: three elongated sections comprising a central section and first and second support sections, section-connecting means connecting said sections together and permitting movement of said sections into storage positions alongside each other and also permitting movement of said sections into slide positions in which said central section inclines downwardly in general parallelism with and also end-to-end relationship with said first support section, when said sections are in said slide position said second support section being disposed upwardly extending and transverse to said central section and at least mostly beneath said central section, and also said section-connecting means permitting movement of said sections into a Jungle Gym position in which said support sections both extend transversely downwardly from and are approximately normal to said central section, said section-connecting means causing the ends of said central section to be firmly supported by said first and second support sections respectively when said sections are in said slide and Jungle Gym positions and while lower ends of said support sections are rested on a horizontal floor surface, said central section having two longitudinal side members interconnected by transverse rungs, said second support section having step means thereon to facilitate climbing thereon, slide panel means on said central and first support sections, and attachment means attaching said slide panel means on said central and first support sections when said sections are in said slide positions, whereby said slide panel means provides a substantially continuous slide surface along the majority of the length of said central and first support sections and whereby said slide panel means will stay in place on said central and first support sections during sliding useage by children and whereby that part of said slide panel means which is disposed on said central section is removable from said central section to permit free use of said rungs when said assembly is in said Jungle Gym position.

2. The assembly of claim 1 in which said slide panel attachment means permits said slide panel means to be removed from said central section without the use of tools.

3. The exercise assembly of claim 1 further having the rungs of said central section being horizontally elongated and as seen in transverse cross-section being substantially curved on their upper sides so that children can comfortably grip said rungs and hang therefrom when said panel means are removed, at least one of said support sections being wider at its lower end than at its upper end for providing stability.

4. The exercising assembly of claim 1 further comprising right and left elongated guard rail assemblies disposed on right and left sides of said central section and substantially parallel with said sides respectively, means securing said guard rail assemblies to the remainder of said exercising assembly.

5. The exercising assembly of claim 1 further comprising right and left elongated guard rail assemblies disposed on right and left sides of said central section and substantially parallel with said sides respectively, means securing said guard rail assemblies to the remainder of said exercising assembly, said assembly when in slide position having: said first support section having an upper portion projecting beyond the end of said central section, said second support section having a portion projecting upwardly beyond the end of said central section, said means securing said guard rail assemblies having pivotal attachments to said projecting portions of said first and second support sections for the pivoting of said first and second support sections about axes which are normal to said elongated central section whereby said exercising assembly can be moved from slide to Jungle Gym position and also folded into storage position with said guard rail assemblies still secured thereto.

* * * * *